US008603259B2

(12) United States Patent
Berner et al.

(10) Patent No.: US 8,603,259 B2
(45) Date of Patent: Dec. 10, 2013

(54) CONVEYOR WAREWASHER AND METHOD FOR OPERATING A CONVEYOR WAREWASHER

(75) Inventors: Dietrich Berner, Waldstetten (DE); Harald Disch, Elzach (DE); Ralf Hubner, Frankfurt (DE); Klaus Padtberg, Korbach (DE)

(73) Assignee: Premark FEG L.L.C., Glenview, IL (US)

( * ) Notice: Subject to any disclaimer, the term of this patent is extended or adjusted under 35 U.S.C. 154(b) by 564 days.

(21) Appl. No.: 12/922,490

(22) PCT Filed: Mar. 5, 2009

(86) PCT No.: PCT/US2009/036095

§ 371 (c)(1),
(2), (4) Date: Sep. 14, 2010

(87) PCT Pub. No.: WO2009/117256

PCT Pub. Date: Sep. 24, 2009

(65) Prior Publication Data

US 2011/0005551 A1 Jan. 13, 2011

(30) Foreign Application Priority Data

Mar. 19, 2008 (DE) ..... 10 2008 014 921

(51) Int. Cl.
*B08B 3/02* (2006.01)

(52) U.S. Cl.
USPC .... 134/56 R; 134/56 D; 134/57 D; 134/58 D; 134/61; 134/67; 134/70; 134/72

(58) Field of Classification Search
USPC ..... 134/25.2, 25.5, 61, 67, 70, 72, 56 R, 134/57 D, 56 D, 58 D
See application file for complete search history.

(56) References Cited

U.S. PATENT DOCUMENTS

| | | | |
|---|---|---|---|
| 6,250,318 | B1 | 6/2001 | Kiat et al. |
| 6,530,996 | B2 | 3/2003 | Värpiö |

(Continued)

FOREIGN PATENT DOCUMENTS

| | | |
|---|---|---|
| DE | 31 20 603 | 12/1982 |
| DE | 9608036 | * 7/1997 |
| DE | 198 29 650 | 1/2000 |
| DE | 10 2004 003 798 | 8/2005 |
| DE | 10 2005 021 101 | 5/2006 |
| DE | 10 2006 014 464 | 10/2007 |
| DE | 10 2006 042 486 | 11/2007 |
| WO | 2008/022741 | 2/2008 |

OTHER PUBLICATIONS

PCT, International Preliminary Report on Patentability, International Application No. PCT/US2009/036095 (Sep. 30, 2010).
PCT, International Search Report and Written Opinion, International Application No. PCT/US2009/036095 (mailed Feb. 4, 2010).

*Primary Examiner* — Saeed T Chaudhry
(74) *Attorney, Agent, or Firm* — Thompson Hine LLP

(57) ABSTRACT

A conveyor warewasher (1) which having at least one washing zone (6, 7, 8, 9), at least one rinsing zone (10) and at least one drying zone (26) and also a control device (36). In order to achieve an effective cleaning and drying of the washware, along with as low a consumption as possible of resources in terms of water, chemicals and, in particular, energy, there is provision for the control device (36) to be designed for selecting a previously defined or definable program sequence at least in the at least one drying zone (26) and for setting the process parameters associated with the selected program sequence automatically as a function of the conveying speed at which the washware is conveyed through the treatment zones (6, 7, 8, 9, 10, 26) of the conveyor warewasher (1).

12 Claims, 2 Drawing Sheets

(56) References Cited

U.S. PATENT DOCUMENTS

| | | | | |
|---|---|---|---|---|
| 2002/0020435 | A1 | 2/2002 | Värpiö | |
| 2006/0107486 | A1 | 5/2006 | Andre | |
| 2007/0125403 | A1* | 6/2007 | Ecker et al. | 134/33 |
| 2008/0029131 | A1 | 2/2008 | Ecker | |
| 2008/0077281 | A1* | 3/2008 | Gaus | 700/299 |

* cited by examiner

CONVEYOR WAREWASHER AND METHOD FOR OPERATING A CONVEYOR WAREWASHER

The invention relates to a conveyor warewasher and to a method for operating such a conveyor warewasher.

The invention accordingly relates particularly to a flight-type conveyor warewasher or a rack conveyor warewasher.

Conveyor warewashers are used in the commercial sector. In contrast to domestic warewashers, in which the washware to be cleaned remains at a fixed location in the machine during cleaning, in conveyor warewashers a transport of the washware through various treatment zones of the conveyor warewasher takes place.

In conveyor warewashers, the washware to be cleaned, such as, for example, dishes, pots, glasses, cutlery and other utensils to be cleaned, is conveyed through a plurality of treatment zones, such as, for example, prewashing zone or zones, main washing zone or zones, postwashing or prerinsing zone or zones, rinsing zone or zones and drying zone or zones. However, different types of washware require, in particular, for example because of their use, their degree of soiling, their shape and the material used, different treatment parameters in the treatment zones of the conveyor warewasher which are spatially separate from one another.

These treatment parameters include, on the one hand, the settable process parameters for the respective treatment zones of the conveyor warewasher, such as, for example, the temperature of a washing fluid to be sprayed in the main washing zone, the nozzle pressure with which a prewashing fluid is sprayed in the prewashing zone, the nozzle pressure with which a washing fluid is sprayed in the main washing zone, the respective volume quantities of prewashing fluid, washing fluid and rinsing fluid to be sprayed per unit time, the temperature of an air stream used in the drying zone for drying the washware and/or the volume quantity of drying air circulating per unit time in the drying zone.

On the other hand, however, in particular, the time of action is also an important treatment parameter for the washware to be cleaned. The time of action is to be understood as meaning that time for which the washware dwells, overall, in a specific treatment zone of the conveyor warewasher. The time of action in this case arises, on the one hand, from the length of the respective treatment zone in the direction of conveyance and, on the other hand, from the conveying speed at which the washware is conveyed through the treatment zones.

Conventionally, conveyor warewashers are designed such that they can be operated at different conveying speeds. The respective conveying speed, as a rule, can be freely selected manually by the operator of the conveyor warewasher and is usually increased or reduced, depending on the capacity or full utilization of the conveyor warewasher and on the available operating personnel. The contact time of the washware in the individual treatment zones changes as a function of the conveyor belt speed which corresponds to the conveying speed at which the washware is conveyed through the respective treatment zones of the conveyor warewasher.

It is already known from the publication DE 10 2005 021 101 A1, in a conveyor warewasher, to switch additional spray nozzles on and off as a function of the conveying speed of the washware in the rinsing zone of the conveyor warewasher, in order thereby to lower the consumption of rinsing-clear water. In this case, sensors are provided, which detect the presence of dishes at the entrance of the conveyor warewasher.

The aim of the present invention is to achieve the object of providing a conveyor warewasher which has at least one washing zone, at least one rinsing zone and at least one drying zone and also a control device and by means of which efficient cleaning and drying of the washware, along with as low a consumption as possible of resources in terms of water, chemicals and, in particular, energy, can be achieved during operation. Furthermore, the object of specifying a corresponding method for operating such a conveyor warewasher is to be achieved.

Since, by means of the solution according to the invention, a previously defined or definable program sequence, at least in the at least one drying zone of the conveyor warewasher, is selected and the process parameters associated with the selected program sequence are set automatically as a function of the conveying speed at which the washware is conveyed through the treatment zones of the conveyor warewasher, it can be ensured that the washware, at least in the drying zone, is treated, basically taking into account the contact time in this treatment zone. Consequently, at least in the drying zone, the process parameters are adapted automatically to the conveying speed and, in particular, to the actual available contact time of the washware in the drying zone.

The control device automatically selects optimal process parameters, depending on the prevailing conveying speed or belt speed. The term "optimal process parameters" is to be understood as meaning process parameters in which the washware to be processed in the at least one drying zone is dried not only effectively, but also particularly economically. In particular, an automatic adaptation of the temperature of the air stream, used in the drying zone for drying the washware, to the actual contact time takes place. Alternatively or additionally to this, it is nevertheless possible that the volume quantity, employed per unit time, of the air stream used in the drying zone for drying the washware is also adapted automatically to the actual contact time.

In this case, the invention is based on the recognition that the washing and drying result is ultimately a product of the process parameters of the treatment zones and of the contact time. Since, according to the invention, a previously defined or definable program sequence, at least in the drying zone, is selected and the process parameters associated with the selected program sequence are set automatically as a function of the conveying speed, an automatic adaptation of the process parameters, applicable to the respective treatment zones, to the contact time takes place.

In contrast to this, in conveyor warewashers known at the present time, the process parameters in the respective treatment zones, as a rule, remain constant for all conveying speeds. The process parameters for the respective treatment zones are in this case usually rated in terms of a specific conveying speed predetermined by the machine manufacturer.

By contrast, in the conveyor warewasher according to the invention, the process parameters, at least in the drying zone, are adapted automatically to the contact time of the washware and are therefore variable in terms of the conveying speed. What can be achieved thereby is that the contact time of the washware in the respective treatment zones of the conveyor warewasher and, in particular, the contact time in the drying zone are no longer than would actually be necessary for sufficient treatment. An over-treatment of the washware is thus avoided.

Since an automatic adaptation and setting of the process parameters applicable to the respective treatment zones take place as a function of the conveying speed, this at the same time counteracts the risk that the washware is only inadequately processed or cleaned, rinsed clear or dried, for example if the operator of the conveyor warewasher increases the conveying speed manually.

Accordingly, basically only as many resources in terms of water, energy and chemicals are consumed as are actually necessary in order to ensure sufficient processing (cleaning, rinsing clear, drying).

The object on which the invention is based is achieved, furthermore, by means of a method for operating a conveyor warewasher which has at least one washing zone, at least one rinsing zone and at least one drying zone and also a control device. According to the invention, in this case, there is provision, by means of the method, for a previously defined or definable program sequence, at least in the at least one drying zone, to be selected and the process parameters associated with the selected program sequence to be set automatically as a function of the conveying speed at which the washware is conveyed through the treatment zones of the conveyor warewasher.

Further features of the invention are specified in the dependent patent claims.

The invention is described below by way of example by means of preferred embodiments, with reference to the drawings in which.

Figure 1:
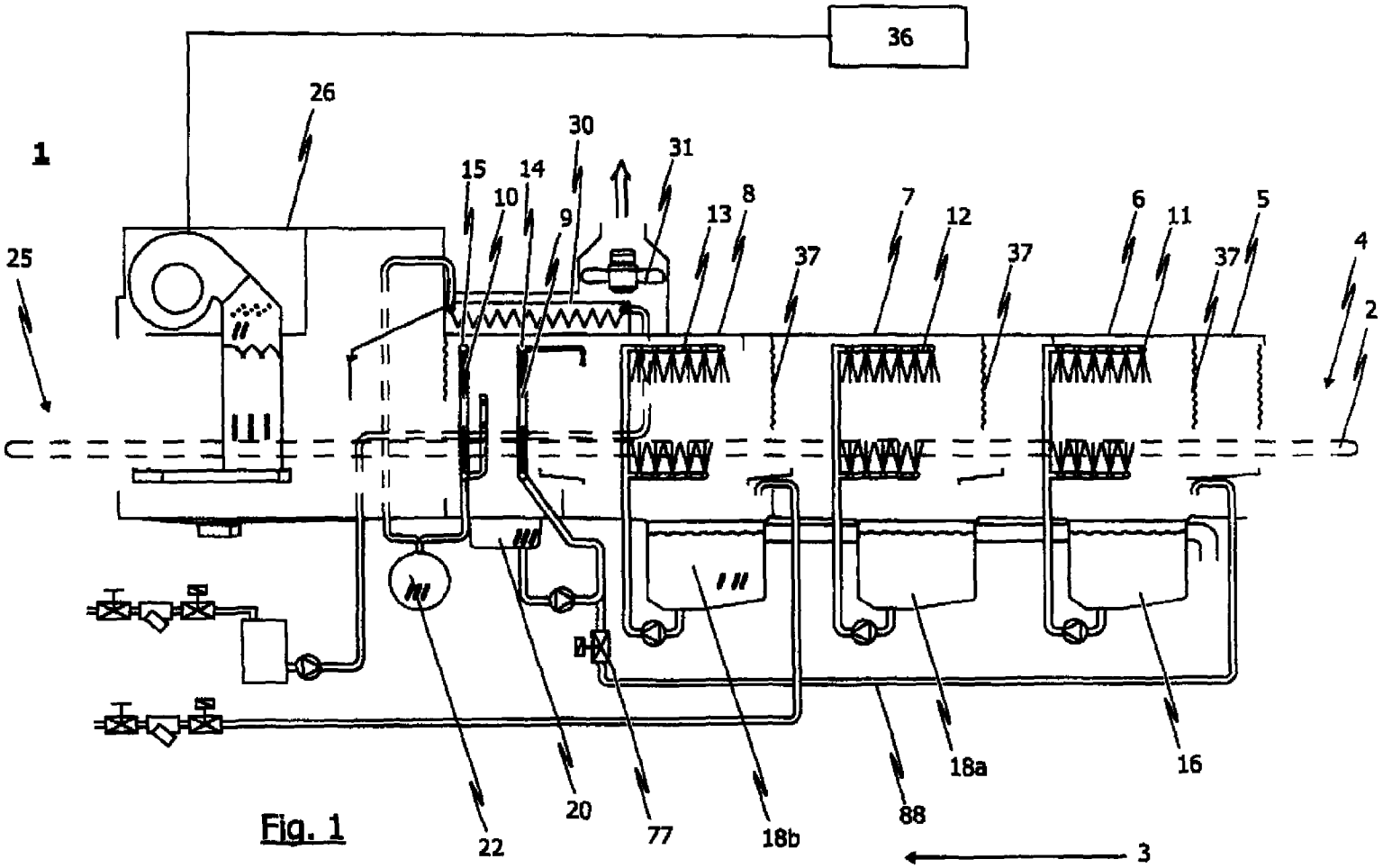
FIG. 1 shows a diagrammatic longitudinal sectional view of a conveyor warewasher according to a first embodiment.

FIG. 1 shows a conveyor warewasher 1 with a conveyor device 2 for conveying washware, not illustrated in the drawings, in a conveying direction 3 through the conveyor warewasher 1. What may be considered as a conveyor device 2 is, for example, a conveyor belt which is preferably designed as a multi-membered plastic conveyor belt and is driven continuously by means of a preferably electric drive, not illustrated in FIG. 1, so that the washware applied to the conveyor belt 2 is conveyed through the various treatment zones 6, 7, 8, 9, and 26 of the conveyor warewasher 1 according to the illustration in FIG. 1. Usually, the washware conveyed in the conveying direction 3 is applied to the conveyor device or conveyor belt 2 in the region of the entry 4. The washware is then conveyed from the entry 4 into an entry tunnel 5 in the conveying direction 3 indicated by the arrow.

The conveyor warewasher 1 has at least one washing zone, for example as illustrated in FIG. 1, one prewashing zone 6 and also a first main washing zone 7 and a second main washing zone 8 which, as seen in the conveying direction 3, are arranged downstream of the prewashing zone 6.

As seen in the conveying direction 3, a postwashing zone 9 and a rinsing zone 10 following the postwashing zone 9 are arranged downstream of the at least one washing zone 6, 7, 8 in the conveyor warewasher 1 illustrated in FIG. 1.

In the illustration according to FIG. 1, the conveyor device 2 is illustrated as a revolving conveyor belt. However, it is also conceivable to have as a conveyor device 2 conveyor racks into which the washware, not illustrated explicitly, is inserted and which are placed on the top side of the conveyor belt.

As seen in the conveying direction 3, either the washware received directly on the conveyor belt 2 or the washware held by racks runs in the conveying direction 3 through the entry tunnel 5, the following prewashing zone 6, the first main washing zone 7, the second main washing zone 8, the postwashing zone 9, the rinsing zone 10 and the drying zone 26 into an exit stage 25.

The said treatment zone 6, 7, 8, 9 and 10 of the conveyor warewasher 1 are assigned in each case spray nozzles 11, 12, 13, 14 and 15, via which fluid is sprayed onto the washware which is transported by the conveyor device 2 through the respective treatment zones 6, 7, 8, 9 and 10. Each treatment zone 6, 7, 8, 9 and 10 is assigned a tank 16, 18, 20 and 22 in which sprayed fluid is received and/or in which fluid is provided for the spray nozzles of the respective zones. In the conveyor warewasher 1 illustrated in FIG. 1, rinsing fluid in the form of fresh water, which may be pure or mixed with further additives, such as, for example, rinse aid, is sprayed, via the spray nozzles 15 of the rinsing zone 10 which are arranged above and below the conveyor belt or laterally, onto the washware, not illustrated in the drawings.

Part of the sprayed rinsing fluid is conveyed from zone to zone opposite the conveying direction 3 of the washware via a cascade system. The remaining part is conducted directly into the prewashing tank 16 via a valve 77 and a bypass line 88.

The sprayed rinsing-clear fluid is intercepted in the tank 20 (postwashing tank 20) of the postwashing zone 9, from which it is conveyed via a pump system to the spray nozzles 14 (postwashing nozzles 14) of the postwashing zone 9. In the postwashing zone 9, washing fluid is washed off from the washware. The fluid occurring in this case flows into the washing tank **18*b* of the second main washing zone 8, is usually provided with a detergent and is sprayed onto the washware by means of a pump system via the nozzles 13 (washing nozzles 13) of the second main washing zone 8. The fluid flows from the washing tank 18*b* of the second main washing zone 8 into the washing tank 18*a* of the first main washing zone 7. The fluid is sprayed from there once again onto the washware by means of a further pump system via the washing nozzles 12 of the first main washing zone 7. The fluid subsequently flows from the washing tank 18*a* of the first main washing zone 7 into the prewashing tank 16 of the prewashing zone 6. The fluid in the prewashing tank 16 is sprayed onto the washware by means of a pump system via the prewashing nozzles 11 of the prewashing zone 6** in order to remove coarse impurities from the washware.

The individual washing systems of the treatment zones 6, 7, 8, 9 and 10 ensure that the washware is sprayed both from the top side and from the underside.

The respective zones 6, 7, 8, 9 and 10 of the conveyor warewasher 1 may be separated from one another via separating curtains 37. In the embodiment illustrated in FIG. 1, the entry tunnel 5 itself is also separated from the entry 4 via a separating curtain 37. By the separating curtains 37 being provided, an over-spraying of washing fluid and rinsing fluid and the escape of vapours from the conveyor warewasher are prevented.

The rinsing zone 10 is followed in the conveying direction 3 of the washware by the already mentioned drying zone 26. In the drying zone 26, the washware is dried by means of dry and heated air, in order to blow off or dry off the moisture located on the washware. In order to keep the moisture content of the air within a range beneficial for drying, it is conceivable, for example, to supply room air via a port, for example through the outlet port for the washware. The hot and moistened air is drawn off from the drying zone 26, for example, with the aid of a blower 31 via a further port. In this case, it is advantageous if the spent-air stream from the drying zone 26 passes through a device for heat recovery 30, in which a condenser may be provided. The device for heat recovery 30 serves for recovering at least part of the heat energy contained in the spent air.

In present-day flight-type/rack conveyor warewashers, the washware is conveyed through a plurality of treatment zones, such as, for example, prewashing zones, main washing zones, afterwashing zones, rinsing-clear zones and drying zones. As already indicated, different types of washware require different treatment parameters in the treatment zones of the conveyor warewasher. In conveyor warewashers known at the present time, however, there is no automatic adaptation of the process parameters set in the respective treatment zones to the respective contact time of the washware to be treated in the individual treatment zones. On the contrary, the conventional systems are usually designed to be a compromise such that they can be used more or less efficiently for different conveying speeds.

This approach, that is to say in which the respective process parameters of the individual treatment zones of the conveyor warewasher are kept constant independent of the contact time, entails the following disadvantages:

If the process parameters of the respective treatment zones are rated, for example, in terms of the highest conveying speed, at lower conveying speeds there is an over-treatment of the washware in the respective treatment zones of the conveyor warewasher. Consequently, in such a case, a disproportionately high consumption of the resources in terms of water, chemicals and, in particular, energy is unavoidable. On the other hand, there is the risk that the washware is not sufficiently cleaned, rinsed clear or dried when the operator of the conveyor warewasher sets too high a conveying speed and the process parameters for the respective treatment zones are rated in terms of a lower conveying speed. A deviation in both directions is unavoidable when the process parameters of the respective treatment zones are rated in terms of a medium conveying speed.

With the aim of avoiding these disadvantages in a way which can be implemented particularly easily, but is nevertheless effective, the conveyor warewasher 1 according to the invention, as is illustrated, for example, in FIG. 1, has a control device 36. The control device 36 is designed for activating different activatable components of the conveyor warewasher 1, such as, for example, motors, heating systems and valves, according to a previously defined or definable program sequence, so that the process parameters in the individual treatment zones 6, 7, 8, 9, 10 and 26 of the conveyor warewasher 1 can thus be suitably set.

Although not illustrated explicitly in FIG. 1, the control device 36 is preferably connected via a suitable communication connection to a control assigned to the drying zone 26. It is thereby possible that the process parameters of the drying zone 26 can be set via the control device 36. According to the invention, the setting of the process parameters takes place automatically as a function of the conveying speed at which the washware is conveyed through the drying zone 26.

In one possible implementation of the conveyor warewasher 1 according to the invention, the control device 36 comprises a storage device, not illustrated in the drawings, to which the control device 36 can have access. In the storage device, in each case a program sequence adapted optimally in economic terms and the process parameters associated with the program sequence, for processing the washware in the drying zone 26, are stored in the storage device at different conveying speeds.

Thus, for example, it is conceivable that, in the case of a low capacity, the conveying speed of the conveyor warewasher 1 is set either manually or automatically by means of mechanical capacity detection to a lowest value for the conveyor warewasher 1. The set value of the conveying speed is communicated to the control device 36 continuously or at defined times or events. For this purpose, it would, for example, be conceivable that the control device 36 is connected via a suitable communication connection to the drive, not illustrated in the drawings, of the conveyor device 2. Of course, it would also be conceivable, however, that suitable sensors connected to the control device 36 are provided, by means of which the conveying speed is detected continuously or at predetermined times or events and the detected value of the conveying speed is communicated to the control device 36.

The control device 36, as a function of the conveying speed, automatically selects, from the storage device belonging to the control device 36, a defined program sequence corresponding to the conveying speed and the associated process parameters and sets the selected process parameters correspondingly in the drying zone 26. In the preferred embodiment of the conveyor warewasher 1, as illustrated, with the aid of the control device 36, a predetermined temperature value of an air stream used in the drying zone 26 for drying the washware is selected and the temperature of the air stream used for drying is set at the selected value automatically as a function of the conveying speed. Alternatively or in addition to this, it is likewise conceivable that, with the aid of the control device 36, a predetermined value of a volume quantity of the drying air circulating per unit time in the drying zone 26 is selected and this selected value is correspondingly set automatically as a function of the conveying speed.

What can thereby be achieved is that, even in the case of a low conveying speed and therefore a relatively long contact time of the washware in the drying zone 26, the temperature and/or the volume quantity of drying air circulating per unit time in the drying zone 26 are/is just sufficient to ensure that the drying of the washware can be terminated at the end of the contact time. As a result, the consumption of energy which is used for providing the (heated) air stream used in the drying zone for drying the washware can be reduced.

In the embodiment illustrated, there is provision for the control device 36 to be designed, furthermore, for selecting a previously defined or definable program sequence in the prewashing zone 6 and/or in one of the two main washing zones 7, 8 as a function of the conveying speed of the washware and for likewise automatically correspondingly setting the process parameters associated with the selected program sequence. In the preferred implementation, illustrated in FIG. 1, of the conveyor warewasher 1 according to the invention, that is to say in which a prewashing zone 6 and two main washing zones 7, 8 are provided, preferably in at least one of the two treatment zones 6, 7, 8 an optimal program sequence should be capable of being selected with the aid of the control device 36 as a function of the conveying speed of the washware and of being set correspondingly.

In this case, for example, process parameters which come under consideration are a volume quantity of prewashing fluid sprayed per unit time in the prewashing zone 6, a pressure value at which the prewashing fluid is sprayed in the prewashing zone 6, a volume quantity of washing fluid sprayed per unit time in at least one of the two main washing zones 7, 8 and/or a pressure value at which the washing fluid is sprayed in at least one of the two main washing zones 7, 8.

It is likewise conceivable that the temperature of the washing fluid sprayed in at least one of the two main washing zones 7, 8 is correspondingly adapted automatically as a function of the conveying speed of the washware.

As illustrated in FIG. 1, the preferred implementation of the conveyor warewasher according to the invention has, furthermore, the already mentioned postwashing zone 9.

Preferably, in this case, the control device 36 is designed for selecting, as a function of the conveying speed of the washware, a previously defined or definable temperature value of an afterwashing fluid to be sprayed in the postwashing zone 9 and for setting the temperature of the afterwashing fluid to be sprayed to the selected value. It is nevertheless conceivable that the control device 36 is designed for selecting as a function of the conveying speed of the washware a previously defined or definable value of a volume quantity of rinsing fluid to be sprayed per unit time in the rinsing zone 10 of the conveyor warewasher 1 and for setting the volume quantity of rinsing fluid to be sprayed per unit time to the selected value.

Accordingly, by means of the preferred embodiment of the conveyor warewasher 1 according to the invention, as it is illustrated, for example, in FIG. 1, it is possible that, in the case of a relatively low conveying speed of, for example, less than 1 m/min, both the respective values for the washing pressure and the respective volume quantities of fluid (prewashing fluid or washing fluid) sprayed per unit time in the prewashing zone 6 and in the two main washing zones 7, 8 are reduced. For example, it would be conceivable that, in the case of a low conveying speed of, for example, less than 1 m/min in the prewashing zone 6, a washing pressure of less than 0.2 bar and a volume quantity of prewashing fluid sprayed per unit time of less than 600 l/min are set. In the main washing zones 7, 8, the temperature of the washing fluid to be sprayed should be set at a reduced value of, for example, 60 to 65° C. As in the prewashing zone 6, too, it is preferable if a low washing pressure of, for example, less than 0.2 bar is selected for the two main washing zones 7, 8. The volume quantities of washing fluid to be sprayed per unit time in the respective washing zones 7, 8 should likewise be set at a low value of, for example, less than 600 l/min.

It would also basically be conceivable that, in the case of a low belt speed, treatment in the first main washing zone 7 is dispensed with completely, in that, for example, the supply of washing fluid to the nozzle system belonging to the first main washing zone 7 is switched off.

Furthermore, it is preferable if, in the case of a low conveying speed, the process temperatures of the main washing zones 7, 8 and of the postwashing zone 9 are in each case lowered, for example, by 5 K. It is likewise sufficient for an optimal processing of the washware to be treated if, in the case of a low conveying speed, the fresh-water rinsing-clear quantity or rinsing fluid quantity to be sprayed per unit time in the rinsing zone 10 is reduced, for example, to 140 to 170 l/h. In addition to this, furthermore, the volume quantity discharged per unit time by the suction-extraction blower 31 may likewise be set at a low value of, for example, less than 700 $m^3$/h. In the drying zone 26, the temperature of the air stream used for drying the washware should be set at a low value of, for example, less than 55° C. The volume quantity of drying air circulating per unit time in the drying zone 26 should likewise be set at low value of, for example, less than 1500 $m^3$/h.

By means of these process parameters adapted to the low conveying speed, an effective cleaning and drying of the washware, at the same time with a saving of resources (energy, fresh water, chemicals), are possible.

If, by contrast, the conveying speed is increased to a medium conveying speed of, for example, 1.0 to 1.5 m/min, for example because of an increase in capacity, it is preferable if the control device 36 automatically sets in each case to a medium value both the volume quantities of prewashing fluid or washing fluid sprayed in each case per unit time in the prewashing zone 6 and in the two main washing zones 7, 8 and the nozzle pressure at which the prewashing fluid or washing fluid is sprayed in the prewashing zone 6 or in the two main washing zones 7, 8. For example, it is conceivable that the washing pressure in the prewashing zone 6 assumes a value of between 0.2 and 0.4 bar and the volume quantity of prewashing fluid sprayed per unit time in the washing zone 6 assumes a value of, for example, 650 l/min. In the two main washing zones 7, 8, it is preferable if the washing pressure assumes a value of 0.2 to 0.4 bar and the volume quantity of washing fluid sprayed per unit time in the two main washing zones 7, 8 assumes in each case a value of, for example, 650 l/min.

In the case of the medium conveying speed, it is preferable, furthermore, if the control device 36 increases the temperature of the postwashing fluid sprayed in the postwashing zone 9, for example, to 75° C.

In the rinsing zone 10, the volume quantity of rinsing fluid sprayed per unit time should be set at a medium value of, for example, 170 to 200 l/h.

In the drying zone 26, it is preferable, in the case of the medium conveying speed, to set the temperature of the drying-air stream to a medium value of, for example, 55 to 65° C. and the volume quantity of drying air circulating per unit time likewise to a medium value of, for example, 1500 to 2500 $m^3$/h. Furthermore, it is preferable if, by means of the control device 36, the suction-extraction blower 31 is activated in such a way that, in the case of the medium conveying speed, a medium volume quantity of, for example, 700 to 900 $m^3$/h is suction-extracted per unit time.

At a high belt speed of, for example, higher than 1.5 m/min, the process parameters applicable to the respective treatment zones 6, 7, 8, 9, 10 and 26 are to be set in each case at their high value. For example, it is conceivable to fix the washing pressure in the prewashing zone 6 at a value higher than 0.4 bar and the volume quantity of prewashing fluid sprayed per unit time at a value of, for example, 800 l/min. In the two main washing zones 7, 8, a washing pressure of, for example, higher than 0.4 bar should be set in each case. The volume quantity of washing fluid sprayed in each case per unit time should be set at a value of, for example, 800 l/min. In the postwashing zone 9, the temperature of the postwashing fluid to be sprayed is to be set at an increased value of, for example, higher than 75° C. For the rinsing zone 10, it is preferable to set the volume quantity of rinsing fluid sprayed per unit time at an increased value of, for example, 200 to 260 l/h. In the drying zone 26, it is preferable if the control device 36 sets the temperature of the drying air to an increased value of, for example, higher than 65° C. and the volume quantity of drying air circulating per unit time likewise to an increased value of, for example, higher than 2500 $m^3$/h. In terms of suction-extraction ventilation, it is preferable, in the case of a high conveying speed, to activate the blower 31 in such a way that an increased volume quantity suction-extracted per unit time of, for example, higher than 900 $m^3$/h can be achieved.

The abovementioned values are illustrative particulars which are not be considered as restrictive.

Figure 2:
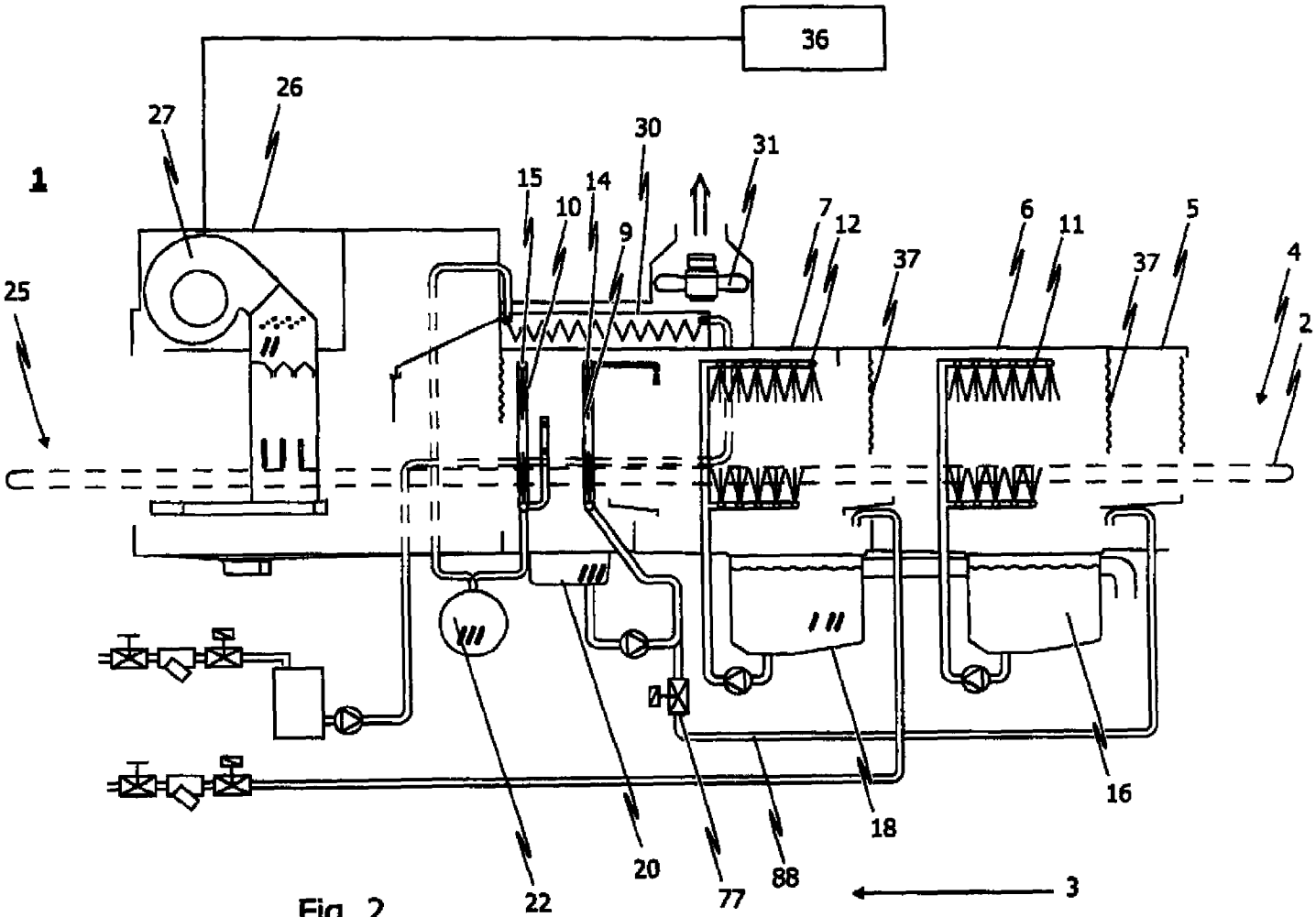
FIG. 2 shows a diagrammatic longitudinal sectional view of a conveyor warewasher according to a second embodiment.

FIG. 2 illustrates a diagrammatic side view of a second embodiment of the conveyor warewasher according to the invention. The conveyor warewasher 1 according to FIG. 2 differs from the embodiment described above with reference to FIG. 1 in that, in the second embodiment, only one main washing zone is provided. The remaining set-up of the conveyor warewasher 1 according to FIG. 2 is identical to the set-up of the conveyor warewasher illustrated in FIG. 1, and therefore reference may be made in this respect to the description relating to FIG. 1.

The invention is not restricted to the embodiments of FIG. 1 and FIG. 2 which are shown by way of example in the drawings.

On the contrary, the invention arises from an overall consideration by a person skilled in the art of the patent claims and of the description of the exemplary embodiment.

The invention claimed is:

1. Conveyor warewasher for the washing of washware, the conveyor warewasher (1) having at least one washing zone (6, 7, 8, 9), at least one rinsing zone (10) and at least one drying zone (26) and also a control device (36), wherein the control device (36) is designed for selecting a previously defined program sequence, at least in the at least one drying zone (26), and for setting the process parameters associated with the selected program sequence automatically as a function of the conveying speed at which the washware is conveyed through the treatment zones (6, 7, 8, 9, 10, 26) of the conveyor warewasher, wherein the control device (36) is designed for selecting a previously defined value of a volume quantity of a drying-air stream circulating per unit time for drying the washware in the at least one drying zone (26) and for setting the volume quantity circulating per unit time to the selected value automatically as a function of the conveying speed of the washware.

2. Conveyor warewasher according to claim 1, wherein the control device (36) is designed for selecting a previously defined temperature value of an air stream used in the at least one drying zone (26) for drying the washware and for setting the temperature of the air stream used for drying to the selected value automatically as a function of the conveying speed of the washware.

3. Conveyor warewasher according to claim 1, which has at least one prewashing zone (6) and at least one main washing zone (7, 8), wherein the control device (36) is designed, furthermore, for selecting a previously defined program sequence in the at least one prewashing zone (6) and for setting the process parameters associated with the selected program sequence automatically as a function of the conveying speed of the washware, and/or in that the control device (36) is designed, furthermore, for selecting a previously defined program sequence in the at least one main washing zone (7, 8) and for setting the process parameters associated with the selected program sequence automatically as a function of the conveying speed of the washware.

4. Conveyor warewasher according to claim 3, wherein the control device (36) is designed for selecting a previously defined value of a volume quantity of prewashing fluid to be sprayed per unit time in the at least one prewashing zone (6) and for setting the volume quantity of prewashing fluid sprayed per unit time to the selected value as a function of the conveying speed of the washware; and/or in that the control device (36) is designed for selecting a previously defined value of a nozzle pressure, under which the prewashing fluid is sprayed in the at least one prewashing zone (6), and for setting the nozzle pressure to the selected value as a function of the conveying speed of the washware.

5. Conveyor warewasher according to claim 4, wherein the control device (36) is designed for selecting a previously defined value of a volume quantity of washing fluid to be sprayed per unit time in the at least one main washing zone (7, 8) and for setting the volume quantity of washing fluid sprayed per unit time to the selected value as a function of the conveying speed of the washware; and/or in that the control device (36) is designed for selecting a previously defined value of a nozzle pressure under which the washing fluid is sprayed in the at least one main washing zone (7, 8), and for setting the nozzle pressure to the selected value as a function of the conveying speed of the washware.

6. Conveyor warewasher according to claim 3, wherein the control device (36) is designed for selecting a previously defined temperature value of a washing fluid to be sprayed in the at least one main washing zone (7, 8) and for setting the temperature of the washing fluid to be sprayed to the selected value as a function of the conveying speed of the washware.

7. Conveyor warewasher according to claim 1, at least one postwashing zone (9) belonging to the washing zone (6, 7, 8, 9), wherein the control device (36) is designed for selecting a previously defined temperature value of an postwashing fluid to be sprayed in the at least one postwashing zone (9) and for setting the temperature of the postwashing fluid to be sprayed to the selected value as a function of the conveying speed of the washware.

8. Conveyor warewasher according to claim 1, wherein the control device (36) is designed for selecting a previously defined value of a volume quantity of rinsing fluid to be sprayed per unit time in the at least one rinsing zone (10) and for setting the volume quantity of rinsing fluid sprayed per unit time to the selected value as a function of the conveying speed of the washware.

9. Conveyor warewasher according to claim 8, wherein a frequency converter activable by the control device is provided, furthermore, for setting the volume quantity of rinsing fluid sprayed per unit time in the at least one rinsing zone (10).

10. Conveyor warewasher according to claim 1, wherein the at least one program sequence selectable automatically by the control device (36) is a program coordinated with the contact time of the washware in the respective treatment zone (6, 7, 8, 9, 10, 26).

11. Conveyor warewasher according to claim 1, wherein the control device (36) is designed for selectively selecting a previously defined program sequence in at least one treatment zone (6, 7, 8, 9, 10, 26) of the conveyor warewasher (1) and for setting the process parameters associated with the selected program sequence automatically as a function of the conveying speed of the washware.

12. Method for operating a conveyor warewasher (1) which has at least one washing zone (6, 7, 8, 9), at least one rinsing-clear zone (10) and at least one drying zone (26) and also a control device (36), wherein a previously defined program sequence, at least in the at least one drying zone (26), is selected and the process parameters associated with the selected program sequence are set automatically as a function of the conveying speed at which the washware is conveyed through the treatment zones (6, 7, 8, 9, 10, 26) of the conveyor warewasher, wherein the control device selects a previously defined value of a volume quantity of a drying-air stream circulating per unit time for drying the washware in the at least one drying zone (26) and sets the volume quantity circulating per unit time to the selected value automatically as a function of the conveying speed of the washware.

* * * * *